US005564760A

United States Patent [19]

Mader

[11] Patent Number: 5,564,760

[45] **Date of Patent: *Oct. 15, 1996**

[54] DOOR LEVER ASSEMBLY HAVING NON-MACHINED FASTENERLESS TRIM

[75] Inventor: Gerald E. Mader, Indianapolis, Ind.

[73] Assignee: Von Duprin, Inc., Indianapolis, Ind.

[ * ] Notice: The term of this patent shall not extend beyond the expiration date of Pat. No. 5,445,423.

[21] Appl. No.: 179,213

[22] Filed: Jan. 10, 1994

[51] Int. Cl.[6] ..... E05C 1/06

[52] U.S. Cl. ..... 292/182; 292/336.3

[58] Field of Search ..... 292/348, 351, 292/DIG. 53, 182, 169.14, 169.17, 241, 336.3

[56] References Cited

U.S. PATENT DOCUMENTS

| | | | |
|---|---|---|---|
| 4,418,552 | 12/1983 | Nolin | 270/107 |
| 4,861,083 | 8/1989 | Fish et al. | 292/336.3 X |
| 4,934,800 | 6/1990 | Choi | 292/336.3 X |
| 4,988,136 | 1/1991 | Gressett, Jr. | 292/336.3 |
| 5,088,786 | 2/1992 | Linder | 292/336.3 X |
| 5,205,596 | 4/1993 | Ralph | 292/336.3 |
| 5,290,077 | 3/1994 | Fleming | 292/35 |
| 5,445,423 | 8/1995 | Mader | 292/336.3 |

*Primary Examiner*—Steven N. Meyers
*Assistant Examiner*—Monica E. Millner
*Attorney, Agent, or Firm*—Robert F. Palermo; A. James Richardson

[57] ABSTRACT

A door lever assembly includes a lever handle rotatably connected to a trim housing. A pair of guide rods positioned in the trim housing support a stop plate and a movable slider. A cam is operably connected to the lever handle and positioned to rotate in response to rotation of the lever handle, converting its rotational movement to linear movement of the movable slider positioned adjacent to the cam. A lift arm is operably connected to the slider to engage and disengage door latches in response to movement of the slider when the door lever assembly is unlocked. When the door lever assembly is locked, an over-ride spring connected between the slider and the lift arm compresses in response to slider movement, preventing damage to components of the door lever assembly. When the door lever assembly is unlocked, a pivot rotates to control contact between the slider and the stop plate.

7 Claims, 3 Drawing Sheets

DOOR LEVER ASSEMBLY HAVING NON-MACHINED FASTENERLESS TRIM

BACKGROUND OF THE INVENTION

The present invention relates to a door lever assembly that is easily assembled and resists damage or vandalism and, more specifically, to a single or double door lever assembly being fitted together without use of machined forgings or castings.

Typically, conventional housings for door levers are constructed from machined forgings or casting. Mounting studs for attachment to the door in such conventional housings consist of male threads that mate with a casting or forging using drilled or tapped holes cut through the housing. Alternatively, milled undercuts in a housing are used to provide spring seats, with containment walls retaining internal sliding members for lifting vertical rods connected to door latches or other manipulable lock elements. Drilled or counterbored holes in the forging are commonly required in this type of milled forging to receive the key cylinder.

Unfortunately, the necessity for drilling or machining these types of conventional housings greatly increases time and cost of door lever assembly. Substantial effort is required to machine and/or drill trim housings to accept and hold components of a door lever assembly. In addition, the need for auxiliary fasteners for attachment of door lever components to a trim housing increase cost and time required for assembly of a door lever assembly. What is needed is a low cost trim housing that does not require auxiliary fasteners, does not require additional drilling or machining for use, and can be constructed from a deep drawn metal stamping using welded studs instead of traditional threaded fasteners to secure door lever assembly components.

Such a fastenerless trim assembly can be used to replace conventional door levers having a fixed lock position that are subject to damage by vandals or those seeking unauthorized entry into commercial or public buildings. A conventional locked door lever extends outward in a substantially horizontal position and can be impacted with hammers or other devices to break the lever or shatter lock components. In addition, it is sometimes possible to use the weight of a person seeking entry to downwardly force a door lever and break the lock mechanism. To partially overcome this problem, certain door levers are designed to have shear pins or other elements for designed failure that break and render the lever mechanism inoperable after application of undue force.

For example, a conventional door lever typically has a trim housing machined or drilled to accommodate a key cylinder lock above a rotatable lever handle that is operably connected to a door latch mechanism. The lever handle is permanently pinned to a shaft that extends inward to engage an eccentrically configured cam. The cam can be rotated to upwardly move a slider plate that is in turn connected to a lift arm. Movement of the lift arm in turn causes movement of vertically directed rods that are connected to retract a door latch. Locking this assembly simply requires rotation of the key cylinder to engage a blocking slide known as a trim lock tumbler that prevents movement of the lift arm, and consequently fixes the slider, cam, shaft, and door lever in a fixed and locked position.

However, with this type of assembly the door lever handle is fixed (in its locked position) to extend horizontally outward. To prevent permanent damage to the lock mechanism, a shear pin is provided to connect cam and the shaft. Application of excessive torque forces to the lever handle causes failure of the shear pin, effectively disconnecting the lever and attached shaft from the remaining elements of the door lever assembly. Although this protects the remaining lock elements from further damage, it does require removal of the trim housing and replacement of the shear pin to restore lever function.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a novel breakaway lever assembly for disengaging an unlocked latch of a lockable door latch assembly. The lockable door latch assembly has an unlocked and a locked position, a lever handle rotatably connected to the trim housing, and a cam operably connected to the lever handle and positioned to rotate in response to rotation of the lever handle. A guide rod is positioned within the trim housing to hold a stop plate, and a slider is movably supported by the guide rod to linearly move in response to rotation of the cam.

The slider additionally supports an attached elastomer for contact with the stop plate when the slider is moved toward the stop plate in response to rotation of the cam. A rotatable pivot is held by the slider and the lift arm to contact the stop plate when the door lever assembly is in its unlocked position, with the rotatable pivot rotating out of position to allow contact between the elastomer attached to the slider and the stop plate when the slider is moved when the door lever assembly is in its locked position.

When the door lever assembly is locked, an over-ride spring connected between the slider and the lift arm may be engaged. The over-ride spring is biased to normally transmit motion of the slider to the lift arm to lift a lift arm when the door latch assembly is in its unlocked position. However, when the door lever assembly is locked by preventing movement of the lift arm, the over-ride spring compresses in response to slider movement, thereby preventing damage to the door lever assembly when excessive forces are applied to the door lever.

The foregoing and other aspects will become apparent from the following detailed description of the invention when considered in conjunction with the accompanying drawing figures.

DETAILED DESCRIPTION

Figure 1:
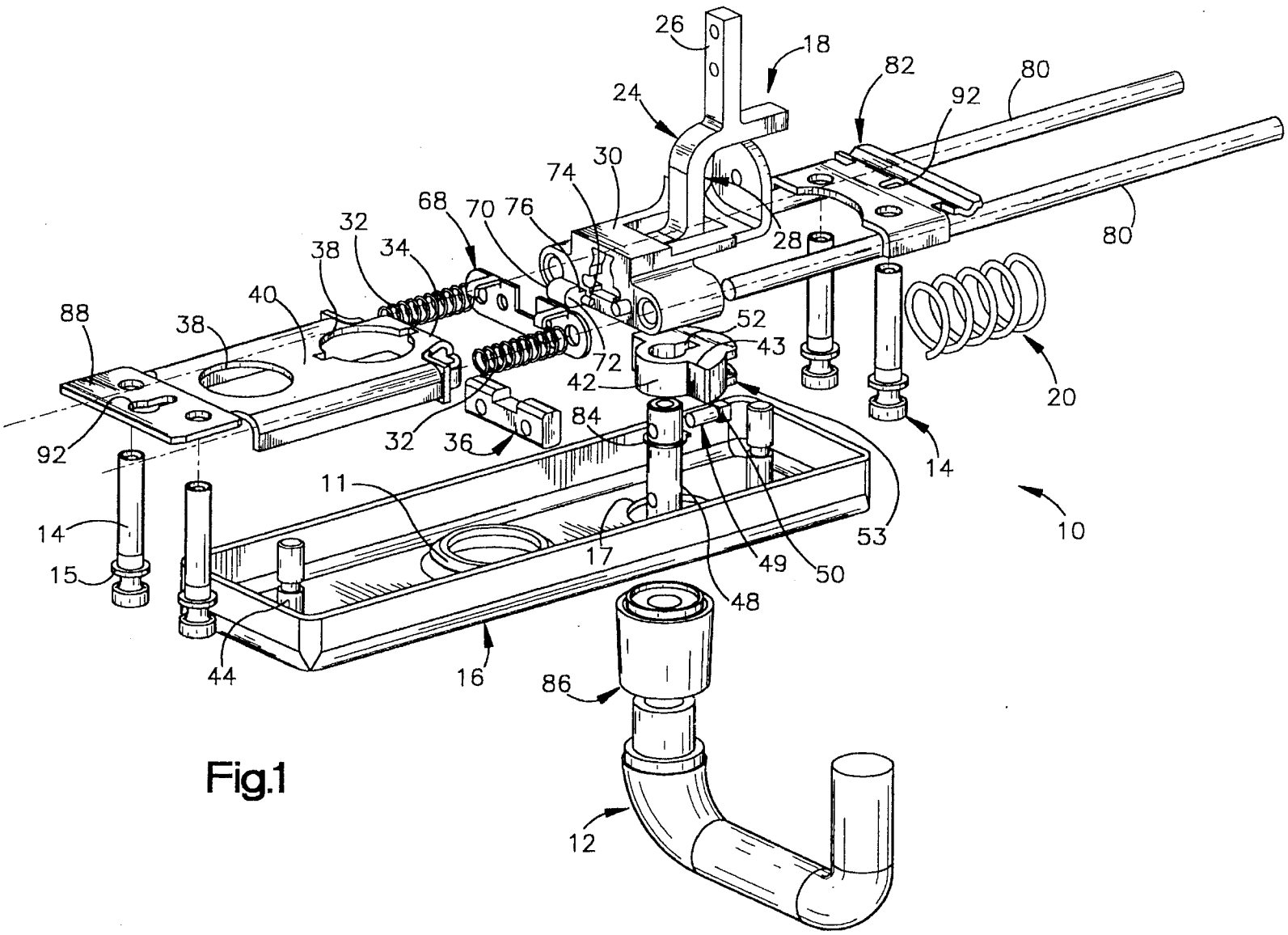
FIG. 1 is an exploded perspective view of a door lever assembly in accordance with the present invention.
Figure 2:
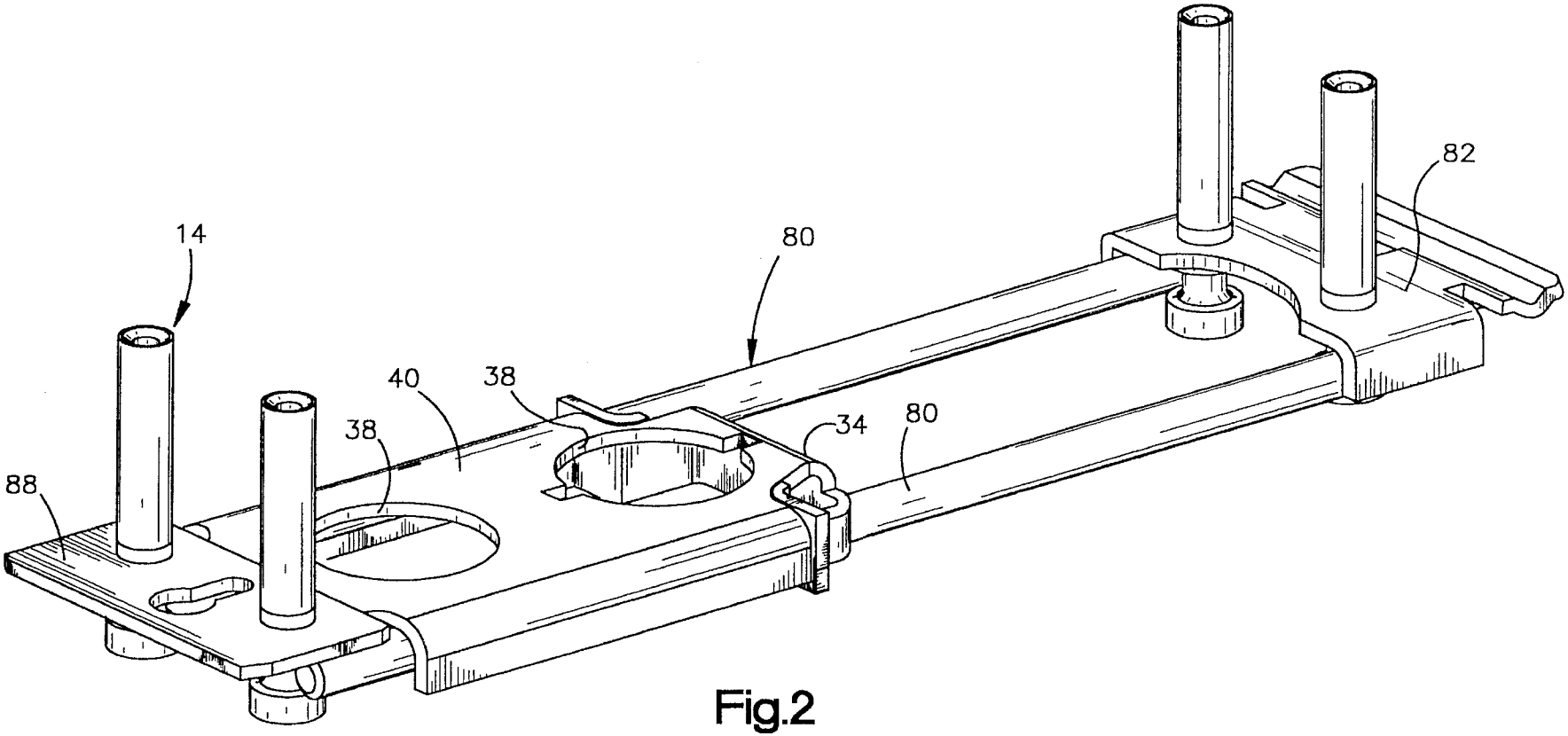
FIG. 2 is a perspective view of fixed, non-movable components of the door lever assembly.
Figure 3:
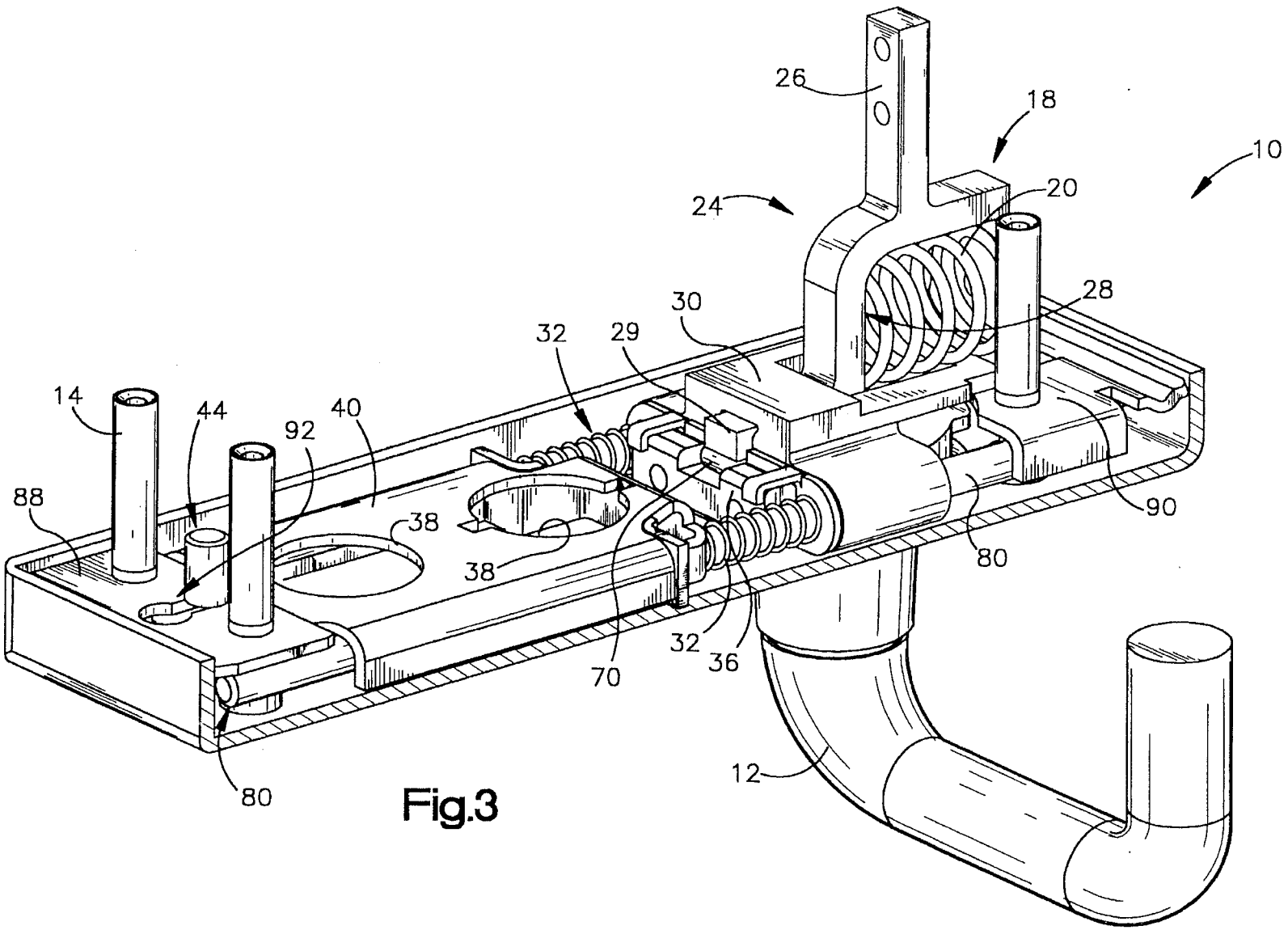
FIG. 3 is a view of the assembled door lever assembly illustrated in FIG. 1.

As illustrated in FIGS. 1, 2 and 3, a door lever assembly 10 includes a stamped, non-machined, trim housing 16 (not shown in FIG. 2 for clarity). Embossment 11 is defined in the trim housing 16 to provide a receptacle for receiving a key cylinder (not shown), and a stamped aperture 17 is also defined in the trim housing to accept passage therethrough of a shaft 48 connected between a door lever 12 and a cam 42. In addition, at opposite ends of the trim assembly, a pair of weld studs 44 are electrically welded to the trim housing 16.

Fitting into this housing 16 is a pair of guide rods 80 that are held in position by a front block 88 and an end block 82. The guide rods 80 are of cylindrically shaped metal construction, and are dimensioned to snugly fit longitudinally within the trim housing 16, with each end adjacent to an edge of the trim housing 16. As will be appreciated from consideration of the Figures, the guide rods 80 are critical components that retain and properly position other components of the door lever assembly 10, including a plate 40 with its door lock apertures 38 and integrally defined turned edge that forms stop plate 34.

Extending respectively through the front block 88 and end block 82 are mounting studs 14. Each mounting stud 14 supports a spacer ring 15 that engages either the front block 88 or end block 82 to hold the blocks 88 or 82 a predetermined distance apart from the trim housing 16. In addition, each mounting stud is relieved to provide a space to conformably accommodate the guide rods 80, and knurled to prevent rotation once pressed through blocks 88 and 82. The blocks 88 and 82 are also respectively provided with key hole slots 92 that hold the blocks in position in the trim housing by engagement with the weld studs 44.

In contrast to the foregoing fixed components, the door lever assembly 10 includes a number of linearly movable or rotatable components. For example, turning a lever handle 12 of conventional design results in linear movement of a lift arm 24, which is engaged to move connected vertical rods (not shown) that operate retraction or extension of door latches (not shown). The door lever assembly 10 of the present invention uses conventional key cylinders (not shown, although a key cylinder would extend through embossment 11 and aperture 38 of FIG. 1) to engage a conventional blocking slide (not shown) that is moved upward or downward by rotation of a key cylinder. When a blocking slide is positioned in a first unlocked, upward position, movement upward of the lift arm 24 is not impeded. The lift arm 24 typically is constructed from a single integral piece of metal to have a flat lock engaging portion 26 and a flat spring engaging portion 28 joined by a curved intermediary portion. A short extension of the lift arm 24 also includes a pivot block 29. The lock engaging portion 26 engages the blocking slide 45 of the door latch lock control assembly when the blocking slide 45 is positioned in its locked position.

The spring engaging portion 28 of the lift arm is conformably attached to an over-ride assembly 18 that includes an over-ride spring 20. The over-ride spring 20 is typically configured to have a high spring constant, and under normal operating torque is essentially inelastic. In addition, a preload of approximately 70 pounds is commonly imparted to the spring to result in an initial lever torque of about 10 foot-pounds. However, when sufficiently high forces are exerted the preload force will be overcome and the spring 20 will begin to compress. As will be appreciated by those skilled in the art, the exact spring material and configuration can be varied, and it is even possible to use elastomeric materials in place of coiled springs as necessary.

The spring engaging portion 28 of the lift arm 24 is also attached to a vertically movable slider 30. The slider 30 is a generally flat plate constrained for movement along the guide rods 80, and in normal operation is vertically movable within the trim housing 16. Vertical movement of the slider is indirectly promoted by rotational movement of the door lever handle 12. The lever handle 12 is connected to the trim housing 16 by a bushing sleeve 86 that allows the handle 12 and the connected shaft 48 to rotate. The shaft is provided with a breakable shear pin 49 and retaining ring 84 for proper positioning and engagement with a connected cam 42. Rotation of the eccentrically configured cam 42 (in response to turning the lever handle 12) causes an integrally defined cam wing 43 to upwardly push the slider 30, which in turn upwardly impels the lift arm 24.

As best seen in FIG. 1, the linearly movable slider 30 has an attached elastomer 36 for engagement with the stop plate 34 defined by the turned edge of the plate 40. Use of a compressible elastomer (or alternative elastic element such as a leaf spring) is important for operation of the present invention, since the elastomer can be slightly compressed if the cam 42 continues to rotate. This provides sufficient room for the cam wing 43 to slip underneath the slider 30, effectively disengaging the cam 42 from the slider 30.

For normal operation without application of excessive forces, dual lift springs 32 are fitted over the guide rods 80 and attached at opposite edges between the slider 30 and plate 40. The lift springs 32 are biased to normally push the slider 30 downward, which in turn acts to rotate the cam 42 and return the lever to a horizontal position. However, these lift springs 32 are ineffective if the cam 42 has been rotated to slip the cam wing 43 past the slider 30.

Manual rotation of the cam 42 is driven by rotation of the door lever handle 12. As illustrated in FIG. 1, the door lever handle 12 is connected by a pin (not shown) to a lever connection site defined at one end of a shaft 48. At an opposite end of the shaft 48, a shear pin 49 having a plurality of flat edges 50 is attached. The shear pin 49 fits into a shear pin connection site having matching flat edged walls 52 defined by the cam 42. The shear pin 49 extends outward in one direction for engagement with the cam 42. As long as torque is maintained with predefined limits, rotation of the door lever handle 12 results in rotation of the shaft 48, and consequent rotation of the shear pin connected cam 42. If rotation of the cam 42 is prevented, application of excessive torque to the door lever handle 12 results in breakage of the shear pin, disconnecting the lever handle 12 from the cam 42.

In its unlocked position, operation of the door lever assembly 10 in accordance with the present invention is augmented by the presence of a pivot 70. As best seen in FIGS. 1 and 3, the pivot 70 has a first lobe 72 separated from a second lobe 74 by a narrow waist 76. The pivot is typically constructed from a durable metal configured to withstand substantial compressive and shear forces without deformation. The pivot is held in position by a pivot retainer 68 that traps the pivot 70 in a pocket defined by the slider 30. In this position, the pivot can rotate within limits defined by the position of the pivot engaging portion 29 of the lift arm 24.

To open the door, the handle 12 is rotated downward, consequently rotating the shaft 48 and shear pin 49 connected cam 42. Rotation of the eccentrically configured cam 42 is converted into upward, linearly directed movement of the slider 30 as the wing 43 of the cam engages and impels the slider 30 upward against the biasing force exerted by the lift springs 32. Movement of the slider 30 also causes movement of the connected lift arm 24. As the lift arm 24 is raised, connected vertical rods (not shown) are moved to release door latches and allow opening of the door. During movement of the lift arm 24, the over-ride spring 20 is essentially uncompressed due to its high spring constant and the relatively low compression forces exerted. However, rotation of the lever handle 12 beyond about 50 to 55 degrees from horizontal is impeded by interaction of the essentially incompressible pivot 70 connected to the slider and held in position by the pivot block 29 of the lift arm 24. The pivot 70 contacts both the slider 30 and the stop plate 34, preventing further movement of the slider 30 toward the stop plate 34, and importantly preventing contact between the elastomer 36 attached to the slider 30 and the stop plate 34. If the pivot 70 was not in position, the elastomer 36 attached to the slider 30 would contact with stop plate 34. Further attempts to rotate the handle will cause the elastomer to compress, allowing the cam wing 43 to slip past the slider 30 so that it is no longer engaged. However, this situation is undesirable because the vertical rods and door latches would be maintained in a retracted "dogged open" position. By having the incompressible pivot 70 drop into position between the elastomer 36 and stop plate 34, the cam wing 43 cannot slip past the slider 30 before its shear pin is broken, disengaging the lever from the cam 42.

Operation of the lever handle is altered when a blocking slide (not shown) is moved downward into a locking position to prevent upward movement of the lift arm 24. Since movement of the lift arm 24 is prevented, the pivot 70 is free to rotate, with its first lobe 72 rotating back toward the slider 30 to permit direct contact between the elastomer 36 and stop plate 34. In addition, movement of the connected slider, cam, shaft, and door lever handle is inhibited. Someone trying to open the door would realize from the resistance to movement of the door lever handle that the door is locked.

However, if someone is trying to force the door by using their weight, pry bars, hammers, or other tools to drive the door lever handle downward, the preload force on the over-ride spring can be overcome and the door handle will rotate to a downwardly directed position. With the present device, the lift arm does not move upward. Instead, against increasingly greater resistance the cam 42 can be force to rotate. As the cam rotates, the slider 30 moves upward, compressing the over-ride spring 20, but not causing movement of the lift arm 24. When the door lever handle is rotated to a downward position of about 50 to 55 degrees, the elastomer 36 engages the stop plate 34. Application of further torque force against the door lever handle 12 merely causes the elastomer 36 to compress, allowing the cam wing 43 to slip past the slider 30 so that it is no longer engaged. Disengagement of the cam 42 from its interaction with the slide 30, allows the lever to travel to a vertically downward position. However, since the lift arm 24 has not been lifted, connected vertical rods remain unmoved, and door latches remain normally engaged to hold the door closed.

Advantageously, the present invention allows the normal operation and use of a door lever assembly that is substantially identical to conventional door lever assemblies when normal forces are exerted. However, when excessive forces are exerted against the door lever handle, such as applied in attempts to force a door lock or vandalize, in an unlocked position the present mechanism disengages the lever from the cam by breakage of the shear pin when to prevent damage to the door lever assembly. In the locked position, the novel door lever assembly absorbs blows (by the over-ride spring) and then disengages to prevent damage. Because of the use of the over-ride spring and the elastomer/stop plate interaction, in single door applications there will be typically no need to rely on shear pin failure to prevent damage to the locked door lever assembly. However, to prevent unwanted dogging open of the door, shear pin failure is still needed as a last resort should excessive forces be applied to an unlocked door. However, as compared to conventional devices, the improved shear pin design and placement make shear pin failure both easier to rely upon and easier to replace.

While the present invention has been described in connection with specific embodiments, it will be apparent to those skilled in the art that various changes may be made therein without departing from the spirit or scope of the invention.

What is claimed is:

1. A door lever assembly comprising:

a trim housing;

a lever handle rotatably connected to the trim housing;

a cam operably connected to the lever handle and positioned to rotate in response to rotation of the lever handle;

a guide rod positioned within the trim housing to hold a stop plate;

a slider movably supported by the guide rod to linearly move in response to rotation of the cam; and a rotatable pivot held by the slider, with the rotatable pivot rotating out of position to allow contact between an elastomer attached to the slider and the stop plate when the slider is moved.

2. The assembly of claim 1, further comprising:

an over-ride spring connected between the slider and a lift arm, with the over-ride spring transmitting motion of the slider to the lift arm to lift the lift arm in its unlocked position, and with the over-ride spring compressing in response to slider movement when the lift arm is in a locked position.

3. A door lever assembly comprising:

a trim housing;

a lever handle rotatably connected to the trim housing;

a cam operably connected to the lever handle and positioned to rotate in response to rotation of the lever handle;

a guide rod positioned within the trim housing to hold a stop plate;

a slider movably supported by the guide rod to linearly move in response to rotation of the cam; and a shaft attached between the lever handle and the cam, with a breakable shear pin attaching the shaft to the cam.

4. The lever assembly of claim 3, wherein the breakable shear pin has at least one flat side to engage a flat wall defined by the cam.

5. The lever assembly of claim 4, wherein the breakable shear pin extends outward from the shaft in only one direction to engage the cam.

6. A door lever assembly comprising:

a trim housing;

a lever handle rotatably connected to the trim housing;

a cam operably connected to the lever handle and positioned to rotate in response to rotation of the lever handle;

a guide rod positioned within the trim housing to hold a stop plate;

a slider movably supported by the guide rod to linearly move in response to rotation of the cam; and a compressible lift spring held by the guide rod and positioned between the stop plate and the slider for compression as the slider moves toward the stop plate for expansion to move the slider away from the stop plate and to return the lever handle to an initial position upon release of the lever handle.

7. A door lever assembly having a locked and an unlocked position, the door lever assembly comprising:

a trim housing rotatably supporting a lever handle;

a cam connected to the lever handle to rotate in response to rotation of the lever handle;

a guide rod positioned in the trim housing to fixably support a stop plate and movably support a slider movable in relation to the stop plate in response to rotation of the cam;

an elastomeric element attached to at least one of the slider or the stop plate;

a pivot rotatable to a position preventing contact between the slider, elastomeric element, and stop plate when the door lever assembly is in an unlocked position, the pivot being rotatable to a position allowing contact between the slider, elastomeric element, and stop plate when the door lever assembly is in a locked position; and a shaft extending in fixed attachment between the lever handle and the cam with a breakable shear pin attaching the shaft to the cam, said breakable shear pin being configured to break upon application of a predetermined amount of torque to the lever handle when the door lever assembly is in its unlocked position.

* * * * *